US005789340A

United States Patent [19]

Brust et al.

[11] Patent Number: 5,789,340

[45] Date of Patent: Aug. 4, 1998

[54] SUBBING LAYER FOR COMPOSITE THERMAL DYE TRANSFER ID CARD STOCK

[75] Inventors: David P Brust, Rochester; Thomas Carl Reiter, Hilton; Peter P Soscia, Geneseo, all of N.Y.

[73] Assignee: Eastman Kodak Company, Rochester, N.Y.

[21] Appl. No.: 688,974

[22] Filed: Jul. 31, 1996

[51] Int. Cl.[6] ..... B41M 5/035; B41M 5/38

[52] U.S. Cl. ..... 503/227; 428/195; 428/304.4; 428/480; 428/483; 428/500; 428/913; 428/914

[58] Field of Search ..... 8/471; 428/195, 428/304.4, 480, 483, 500, 913, 914; 503/227

[56] References Cited

U.S. PATENT DOCUMENTS 5,147,846 9/1992 Harrison et al. ..... 503/227
5,420,095 5/1995 Bodem et al. ..... 503/227

*Primary Examiner*—Bruce H. Hess
*Attorney, Agent, or Firm*—Harold E. Cole

[57] ABSTRACT

An identification card stock comprising a polymeric core substrate having on at least one side thereof the following layers in order: an oriented polymeric film, a cushion layer of an acrylic polymer, a subbing layer and an image-receiving layer; wherein the subbing layer comprises from about 5 to about 35% by weight of acrylonitrile, from about 2 to about 10% by weight of acrylic acid, and from about 55 to about 85% by weight of recurring units of vinylidene chloride; and process of using same.

19 Claims, No Drawings

SUBBING LAYER FOR COMPOSITE THERMAL DYE TRANSFER ID CARD STOCK

This invention relates to a composite thermal dye transfer identification (ID) card stock, and more particularly to a subbing layer for a laminated polyester ID card stock having improved durability and process of using same.

In recent years, thermal transfer systems have been developed to obtain prints from pictures which have been generated electronically from a color video camera. According to one way of obtaining such prints, an electronic picture is first subjected to color separation by color filters. The respective color-separated images are then converted into electrical signals. These signals are then operated on to produce cyan, magenta and yellow electrical signals. These signals are then transmitted to a thermal printer. To obtain the print, a cyan, magenta or yellow dye-donor element is placed face-to-face with a dye-receiving element. The two are then inserted between a thermal printing head and a platen roller. A line-type thermal printing head is used to apply heat from the back of the dye-donor sheet. The thermal printing head has many heating elements and is heated up sequentially in response to one of the cyan, magenta or yellow signals, and the process is then repeated for the other two colors. A color hard copy is thus obtained which corresponds to the original picture viewed on a screen. Further details of this process and an apparatus for carrying it out are contained in U.S. Pat. No. 4,621,271, the disclosure of which is hereby incorporated by reference.

The use of ID cards has become widespread, especially for driver's licenses, national ID cards, bank and other authority cards, for example. Security is important for such cards, and an important security feature of such cards is the use of a continuous tone color photograph printed in the same layer along with other personal, variable data. This type of information can be rapidly and conveniently placed onto an ID card by use of an electronic camera, a computer, and a computer-controlled digital printer. For example, a video camera or a digital still camera can be used to capture a person's image and a computer can record the corresponding personal, variable data. The image and data can then be printed onto an ID card stock material by a computer-controlled thermal dye transfer printer using the apparatus described in U.S. Pat. No. 4,621,271 referred to above.

The convenience and rapid access of electronically-generated ID cards makes desirable an ID card stock pre-cut to the proper size, readily transportable through a printer, and capable of exiting the printing hardware in the form of a finished card. Off-line lamination after printing and die cutting to size after lamination are undesirable because of the manual labor and time required. A pre-cut ID card which can be printed as is in a thermal printer is known as a "direct printing card".

Poly(vinyl chloride) (PVC) and/or poly(vinyl chloride/acetate), polyesters, polyethylenes and polycarbonates are known for use as ID card materials. PVC-based cards have been the most widely used, but such cards have a short lifetime of only one to two years due to the marginal physical properties of PVC. PVC is also known to readily absorb plasticizers from other objects thereby further degrading its physical properties. Furthermore, PVC-based cards have also shown a tendency to stick to thermal dye-donors during printing at high densities such that on separation from the card, the dye layer of the dye-donor delaminates and sticks to the card.

Co-pending U.S. application Ser. No. 08/688,975 of Reiter, Soscia and Brust filed of even date herewith and entitled, "Composite Thermal Dye Transfer ID Card Stock," relates to a laminated ID card stock for use in a thermal dye transfer process. It is an object of this invention to provide a subbing layer for a cushion layer useful for that ID card stock.

U.S. Pat. No. 5,420,095 relates to a subbing layer comprising poly(vinyl acetal) between a polycarbonate-based dye-receiving layer and an acrylic cushion layer in a receiver for thermal dye transfer. While this subbing layer has been found to be useful in many applications, there is a problem with using this subbing layer in a composite ID card stock. In particular, it was found that this subbing layer degraded under the conditions of heat and pressure needed to prepare an ID card stock. In addition, bending of the ID card stock further degraded the adhesivity of such a subbing layer.

U.S. Pat. No. 5,147,846 discloses the use of a vinylidene chloride terpolymer subbing layer between a cushion layer and a dye image-receiving layer. However, there is no disclosure in this patent that this subbing layer would be useful in preparing an image-receiving element for an ID card stock.

It is an object of this invention to provide a composite ID card stock and process of using same which has a subbing layer between the dye image-receiving layer and a cushion layer, which subbing layer will survive the high heat and pressure conditions used in making an ID card stock.

This and other objects are achieved in accordance with this invention which comprises an identification card stock comprising a polymeric core substrate having on at least one side thereof the following layers in order: an oriented polymeric film, a cushion layer of an acrylic polymer, a subbing layer and an image-receiving layer; wherein the subbing layer comprises from about 5 to about 35% by weight of acrylonitrile, from about 2 to about 10% by weight of acrylic acid, and from about 55 to about 85% by weight of recurring units of vinylidene chloride.

The vinylidene chloride terpolymer subbing layer employed in this invention is described more fully in U.S. Pat. Nos. 4,748,150 and 5,147,846, the dislcosures of which are hereby incorporated by reference. In a preferred embodiment of the invention, the subbing layer comprises poly (acrylonitrile-co-vinylidene chloride-co-acrylic acid) (14:79:7 wt. ratio). The subbing layer may be employed at any concentration which is effective for the intended purpose. In general, good results are achieved at from about 0.03 to about 1 g/m$^2$ of coated element.

The cushion (or compression) layer of an acrylic polymer employed in this invention is described more fully in U.S. Pat. No. 4,734,397, the disclosure of which is hereby incorporated by reference. The function of this layer is to reduce dropouts in the printing process caused by dirt and dust. The polymers in this patent include poly(methyl methacrylate), poly(styrene-co-acrylonitrile), poly(n-butyl acrylate-co-acrylic acid), etc. In a preferred embodiment of the invention, the cushion layer is a copolymer of butylacrylate and acrylic acid. The cushion layer may be employed at any concentration which is effective for the intended purpose. In general, good results are achieved at a coverage of at least about 3 g/m$^2$ of coated element.

The ID card structure of the invention is readily suited to making a direct pre-cut card with improved physical properties as compared to PVC-based cards. The ID card stock of the invention provides improved flexural durability over an extended period of time vs. PVC, while retaining good stiffness and impact strength. The ID card material can have layers specifically adapted for thermal printing on both front and back sides, if desired. The card also has separate sites on the polymeric core for printing non-varying information using printing methods other than thermal transfer. The invention also allows one to make use of dye-receiving layers which function well with dye-donors designed to give high maximum density at very short line times without the dye-donor sticking problem encountered with prior art ID cards.

Pre-cut ID card stock can be easily produced by conventional methods using the above-described composite film structure in the conventional shape, size, e.g., 54.5 mm×86 mm, and having a thickness of about 0.8 mm. A pre-cut card stock is one which is made to the card size specifications before printing and exits the printer system without any further triming or cutting required. An overcoat laminate may be applied after printing if desired.

The thickness of both the polymeric core substrate and oriented polymeric film is variable, but the overall thickness is usually in the range of 685 to 838 μm (27–33 mils). The outer surfaces of the ID card stock can be thermally printed with dye images or text. Optionally, non-varying information, such as lines, line segments, dots, letters, characters, logos, guilloches, etc., can be printed on the polymeric core substrate by non-thermal dye transfer methods such as flexo or offset printing before attaching the polymeric core substrate to the oriented polymeric film or films carrying the external dye-receiving layer or layers.

The composite ID card stock of the invention can also be readily milled for placement of a memory chip. Alternatively, the polymeric core substrate and an oriented polymeric film can be pre-punched before attaching to provide a suitable site for a memory chip.

The polymeric core substrate employed in the invention can comprise, for example, an amorphous polyester, a biaxially-oriented polyester, poly(vinyl chloride), copolymers of poly(vinyl chloride) with the latter constituting more than 50 mole % of the copolymer, polypropylene, and polypropylene copolymers. In a preferred embodiment of the invention, the polymeric core substrate is an amorphous polyester such as EASTAR® PETG 6763, a copolyester from Eastman Chemical Products Company, that is believed to comprise 16 weight % cyclohexanedimethanol, 34 weight % ethylene glycol, and 50 weight % terephthalic acid, and which has a Tg of 81° C. The polymeric core substrate may also be a composite laminate, such as a laminate of the above materials, if desired. The thickness of the polymeric core substrate can be, for example, from 127 to 787 μm (5–31 mils).

The polymeric core substrate may also include pigments for opacification, such as white pigments, e.g., titanium dioxide, barium sulfate, calcium sulfate, calcium carbonate, zinc oxide, magnesium carbonate, silica, talc, alumina and clay. Suitable pigments may be homogeneous and consist essentially of a single compound such as titanium dioxide or barium sulfate alone. Alternatively, a mixture of materials or compounds can be used along with an additional modifying component such as a soap, surfactant, coupling agent or other modifier to promote or alter the degree to which the pigment is compatible with the substrate polymer.

In general, any pigment employed in the polymeric core substrate has an average particle size of from 0.1 to 1.0 μm, preferably from 0.2 to 0.75 μm. The amount of pigment that is incorporated is generally between about 5% and 50% by weight, preferably about 15 to about 20%, based on the weight of the core polymer.

The polymeric core substrate can be formed by conventional methods such as coating, lamination, co-extrusion and hot-melt extrusion. A preferred method comprises heating a pigmented, amorphous polyester to a temperature above its melting point and continuously melt extruding the material in sheet form through a slot die onto a chilled casting drum, after which it solidifies. The amorphous, opaque sheet may then be cooled and rolled. Such pigmented films are available commercially in various thicknesses.

The oriented polymeric film located on at least one, and preferably on both, outermost sides of the ID card stock of the invention can be, for example, polycarbonates, polyesters such as poly(ethylene naphthalate) and poly(ethylene terephthalate) (PET), polyolefins, polyamides, cellulose esters, polystyrene, polysulfonamides, polyethers, polyimides, poly(vinylidene fluoride), polyurethanes, poly (phenylene sulfides), polytetrafluoroethylene, polyacetals, polysulfonates, polyester ionomers, polyolefin ionomers, copolymers and mixtures of the above, etc. In a preferred embodiment of the invention, a synthetic linear polyester is employed. Such a material is well known to those skilled in the art and is obtained by condensing one or more dicarboxylic acids or their lower (up to 6 carbon atoms) diesters, e.g., terephthalic acid, isophthalic acid, phthalic acid, 2,5-, 2,6- or 2,7-naphthalenedicarboxylic acid, succinic acid, sebacic acid, adipic acid, azelaic acid, 4,4'-diphenyldicarboxylic acid, hexahydroterephthalic acid or 2-bis-p-carboxyphenoxyethane (optionally with a monocarboxylic acid, such as pivalic acid), the corresponding dicarboxylic acid diaryl ester or lower alkyl ester with one or more glycols, e.g., ethylene glycol, 1,3-propanediol, 1,4-butanediol, neopentyl glycol and 1,4-cyclohexanedimethanol. In a preferred embodiment, the polyester polymer is obtained by condensing terephthalic acid or 2,6-naphthalenedicarboxylic acid or their dimethyl esters with ethylene glycol. In another preferred embodiment, the polymer is PET. The PET film prepared from the above-described composition must be oriented. In a preferred embodiment, the PET film is biaxially-oriented. Such a process is described in many patents, such as GB 838,708, the disclosure of which is hereby incorporated by reference. These techniques are well known to those skilled in the art.

The thickness of the oriented polymeric film employed in the invention can be, for example, 19 μm (0.75 mils) to 178 μm (7 mils).

The oriented polymeric film may also have on one side thereof an antistatic layer to avoid accumulation of static charges during high speed coating of the various layers from organic solvents, and to minimize attachment of dirt which can produce defects in subsequent construction of the ID card stock itself. A preferred material is vanadium pentoxide in poly(acrylonitrile-co-vinylidene chloride-co-acrylic acid) as described in co-pending U.S. application Ser. No. 08/688,975 of Brust, Reiter, and Soscia, filed of even date herewith, and entitled "Backing Layer For Composite Thermal Dye Transfer ID Card Stock."

Receiving layer polymers employed in the invention, either on the topside, bottomside, or both sides, include polycarbonates, polyurethanes, polyesters, polyvinyl chlorides, poly(styrene-co-acrylonitrile), polycaprolactone or any other receiver polymer or mixtures thereof. In a preferred embodiment, the receiving layer is a dye image-receiving layer which comprises a polycarbonate. Preferred polycarbonates include bisphenol-A polycarbonates having a number average molecular weight of at least about 25,000. Examples of such polycarbonates include General Electric LEXAN® Polycarbonate Resin, Bayer AG MACROLON 5700®, and the polycarbonates disclosed in U.S. Pat. No. 4,927,803, the disclosure of which is incorporated by reference.

The dye image-receiving layer employed in the invention may be present in any amount which is effective for its intended purposes. In general, good results have been obtained at a receiver layer concentration of from about 1 to about 10 g/m$^2$, preferably from about 0.1 to about 1 g/m$^2$.

The outer oriented polymeric film or films used in the invention, such as PET, may be attached to the polymeric core substrate by extrusion, lamination, extrusion lamination, cold roll lamination, adhesive, etc. If an adhesive is to be used, it is dictated by the nature of the layers on the PET side opposite the dye image-receiver side as well as the material comprising the polymeric core substrate. This adhesive layer can be formed by use of conventional adhesives of the aqueous solution type, emulsion type, solvent type, solvent-less type, solid type, or those in the form of films, tape or webs. The adhesive can be applied to the polymeric core substrate or to the back side layers of the PET film or to both but is preferably only applied to the PET film. The coated adhesive must allow winding and storage of the PET film at moderate temperatures without occurrence of blocking.

In a preferred embodiment, a heat- and pressure-activated, thermoplastic, adhesive is coated from solvent on the back side (opposite from the dye image-receiving layer) of the PET films only. An effective adhesive is one which produces a bond of sufficient strength so that cohesive failure occurs within the PET rather than at the adhesive when an attempt is made to rip apart the composite card.

The composite is placed between flat plates, then heat and pressure appropriate for the adhesive are applied for a suitable time. After cooling and removal from the press, the large sheets are cut into strips and fed into a die which cuts cards to the desired dimensions from the strips. The location of die cutting is controlled by sensing black marks preprinted on the polymeric core material.

In another embodiment of the invention, other features normally used in ID cards may be employed, such as signature panels, magnetic stripes, holographic foils, etc. These features are placed on the composite card at appropriate locations.

Dye-donor elements that are used with the ID card dye-receiving element of the invention conventionally comprise a support having thereon a dye-containing layer. Any dye can be used in the dye-donor element employed in the invention provided it is transferable to the dye-receiving layer by the action of heat. Especially good results have been obtained with sublimable dyes. Dye-donor elements applicable for use in the present invention are described, e.g., in U.S. Pat. Nos. 4,916,112; 4,927,803 and 5,023,228, the disclosures of which are hereby incorporated by reference.

As noted above, dye-donor elements are used to form a dye transfer image. Such a process comprises imagewise-heating a dye-donor element and transferring a dye image to a dye-receiving layer on the ID card as described above to form the dye transfer image.

The dye-donor element employed in certain embodiments of the invention may be used in sheet form or in a continuous roll or ribbon. If a continuous roll or ribbon is employed, it may have only one dye thereon or may have alternating areas of different dyes such as cyan, magenta, yellow, black, etc., as disclosed in U.S. Pat. No. 4,541,830.

In a preferred embodiment of the invention, a dye-donor element is employed which comprises a poly(ethylene terephthalate) support coated with sequential repeating areas of cyan, magenta and yellow dye, and the above process steps are sequentially performed for each color to obtain a three-color dye transfer image. Of course, when the process is only performed for a single color, then a monochrome dye transfer image is obtained.

Thermal printing heads which can be used to transfer dye from dye-donor elements to the ID card receiving elements of the invention are available commercially. There can be employed, for example, a Fujitsu Thermal Head (FTP-040 MCS001), a TDK Thermal Head F415 HH7-1089, Kyocera KBE-57-12MGL2 Thermal Print Head or a Rohm Thermal Head KE 2OO8-F3. Alternatively, other known sources of energy for thermal dye transfer may be used, such as lasers as described in, for example, GB No. 2,083,726A.

A thermal dye transfer assemblage of the invention comprises (a) a dye-donor element as described above, and (b) an ID card dye-receiving element as described above, the dye-receiving element being in a superposed relationship with the dye-donor element so that the dye layer of the donor element is in contact with the dye image-receiving layer of the receiving element.

When a three-color image is to be obtained, the above assemblage is formed on three occasions during the time when heat is applied by the thermal printing head. After the first dye is transferred, the elements are peeled apart. A second dye-donor element (or another area of the donor element with a different dye area) is then brought in register with the dye-receiving element and the process repeated. The third color is obtained in the same manner. If the ID card stock has dye-receiving layers on both sides, the thermal printing process can then be applied to both sides of the cards.

After the card is thermally imaged, a transparent protective layer can be formed on the surface of the image-receiving layer if desired. This can be done by use of a dye-donor element which includes an additional non-dye patch comprising a transferable protection layer as disclosed in U.S. Pat. Nos. 5,332,713 and 5,387,573, the disclosures of which are incorporated by reference. A protective layer applied in this manner provides protection against image deterioration due to exposure to light, common chemicals, such as grease and oil from fingerprints, and plasticizers often found in items made with poly(vinyl chloride) such as wallets.

A clear, protective layer of equal or greater thickness than that applied from the dye-donor may also be applied to the card using a laminator with heat and pressure. Preferably this protective layer is transferred from a carrier film either in-line or off-line from the thermal printer using a hot roll laminator. Protective layer materials employed are clear thermoplastic polymers whose exact composition is dictated by the ability to adhere to the dye image-receiver layer and to provide the desired, specific protective properties. The protective layer must not degrade the image nor affect image stability to heat and light. Such layer may also incorporate other materials, such as ultraviolet light absorbers. The protective layer may also incorporate security devices such as holographic images.

The following examples are provided to further illustrate the invention.

EXAMPLE 1

Invention 1

A dye-receiver used for a composite card stock of the invention was prepared in the following manner:

On both sides of a 178 μm thick, transparent, biaxially-oriented PET film was coated a subbing layer of poly (acrylonitrile-co-vinylidene chloride-co-acrylic acid) (14:79:7 wt. ratio) (0.05 g/m$^2$) and DC-1248 surfactant (0.016 g/m$^2$) (Dow Corning Corp.) coated from methyl ethyl ketone. On one side of the subbed PET were coated the following layers:

1) a compliant layer of a mixture of poly(n-butyl acrylate-co-acrylic acid) (50:50 wt. ratio) (8.1 g/m$^2$), 1,4-butanediol diglycidyl ether (0.57 g/m$^2$), tributylamine (0.32 g/m$^2$), and Fluorad® FC-431 perfluoroamido surfactant (3M Corp.) (0.016 g/m$^2$) from acetone/water solvent;
2) a subbing layer of a mixture of poly(acrylonitrile-co-vinylidene chloride-co-acrylic acid) (14:79:7 wt. ratio) (0.54 g/m$^2$), and DC-1248 surfactant (0.016 g/m$^2$) (Dow Corning Corp.) coated from methyl ethyl ketone;
3) a dye image-receiving layer of a mixture of Makrolon® KL3-1013 polycarbonate, (Bayer AG), (1.78 g/m$^2$), Lexan® 141-112 poly-carbonate (General Electric) (1.45 g/m$^2$), dibutyl phthalate, (0.32 g/m$^2$), diphenyl phthalate, (0.32 g/m$^2$), and Fluorad® FC-431 (0.011 g/m$^2$) dissolved in methylene chloride; and
4) an overcoat layer comprising a mixture of a random terpolymer polycarbonate (50 mole % bisphenol A, 49 mole % diethylene glycol, and 1 mole % 2,500 m.w. polydimethylsiloxane block units) (0.22 g/m$^2$), Fluorad® FC-431 and Dow-Corning 510 Silicone Fluid (a mixture of dimethyl and methyl phenyl siloxanes) (0.005 g/m$^2$) dissolved in methylene chloride.

On the opposite side of the subbed support were coated the following layers:

1) an antistatic layer coated from an aqueous formulation of 0.025 wt. % silver-doped vanadium pentoxide, 0.025 wt. % of poly(acrylonitrile-co-vinylidene chloride-co-acrylic acid) and 0.01 wt. % OLIN 10G surfactant (p-nonyl phenoxy polyglycidol available from OLIN Corp.) to give a dry weight of about 0.006 g/m$^2$; and
2) an overcoat layer of Elvacite® 2041 (poly(methyl methacrylate) from DuPont Co.) (1.08 g/m$^2$), matte beads (3–4 μm) of poly(methyl methacrylate-co-ethylene glycol methacrylate) (0.025 g/m$^2$), and Fluorad® FC-431 (a surfactant available from 3M Corp.) coated from methylene chloride.

Over the protective coating was applied a heat- and pressure-activated, thermoplastic resin-type adhesive of a terpolymer of vinyl chloride, vinyl acetate and maleic acid (4.1 g/m$^2$) coated from solvent.

Control 1

A dye-receiver similar to Invention 1 was prepared for a control card stock except that the subbing layer between the compliant layer and dye image-receiving layer was as follows: KS-1, a poly(vinyl acetal-co-vinyl alcohol) 74 mole-% acetal, 25 mole-% vinyl alcohol, 1 mole-% vinyl acetate units (Sekisui Chemical Co.) (0.54 g/m$^2$) coated from a solution in 2-butanone/methanol 85/15 containing Fluorad® FC-431. The control dye-receiver was then coated with adhesive as in the invention dye-receiver.

A wide coating of the PET film described above was trimmed at the edges and the edges were marked as A and B. The coating was then slit up along its center in the machine direction into two slits each (610 mm ) in width. Rectangular pieces were then cut (826 mm) in length from the slits, keeping those pieces having edge A separate from those having edge B.

A piece of the PET film bearing edge A was placed with the adhesive side down on a piece of white, pigmented, amorphous polyester core slightly smaller in size and about 356 μm thick. The amorphous polyester was EASTAR® PETG 6763 (Eastman Chemical Co.). The white pigment in the polyester core was $TiO_2$. A piece of the PET film bearing edge B was placed on the opposite side of the polyester core, with the adhesive side in contact with the polyester core, and edge B was placed so that edge A was superimposed over it. The white polyester sheet was printed before forming the composite to provide marks for controlling the die cutting of the cards from the glued composite.

The composite and metal plates enclosing the composite were placed in a platen press, then heat (about 110° C.) and pressure (about 17 bar) were applied for about 18 minutes, followed by cooling to produce an ID card.

The finished cards were then tested to compare the adhesion of the interlayers between the dye-receiving layer and the compliant layer. Each card was scored with the steel point of a 0.5 mm Pentel® mechanical pencil such that seven equally spaced lines (spacing about 6.4 mm), 25 mm long, were drawn from the narrow edge of the card in the long direction of the card. The angle of attack of the pencil point was about 45 degrees and moderate force was exerted.

Scotch Magic® Transparent tape 19 mm wide (3M Corp. 07378-6) was then placed over the scored lines such that the tape covered the narrow width of the card and extended about 25 mm beyond the edge of the card to provide a handle. The tape was rubbed to insure good contact, then the tape was sharply ripped off from the card at about a 135 degree angle.

The amount removed was variable, averaging about 25% of the area covered by the tape. Failure in the tape test was assigned if any removal of any dye-receiving layer occurred; pass indicated no visible removal of the dye-receiving layer. The following results were obtained:

TABLE 1

| Card | Subbing Layer | % Removal of Dye-Receiver Layer | Tape Test |
|---|---|---|---|
| Invention 1 | Vinylidene chloride terpolymer | 0% | Pass |
| Control 1 | Poly (vinyl acetal) | 25% | Fail |

The above results show that the composite ID card having the subbing layer of the invention between the compliant layer and dye-receiving layer showed no removal of dye-receiving layer by the tape test, as compared to the control which always showed removal of the dye-receiving layer. Thus, the invention subbing layer had better adhesion to the compliant layer than did the control subbing layer.

EXAMPLE 2

The following dyes were used in preparing the dye-donor element used below:

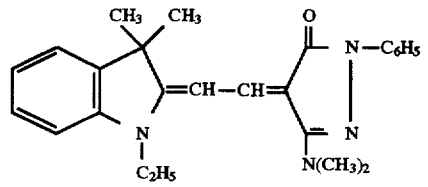

Yellow Dye Y-1

-continued

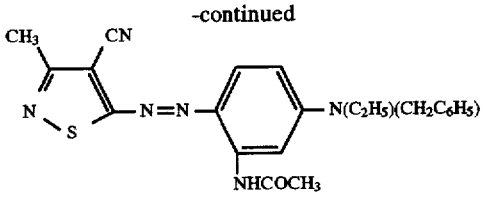

Magenta Dye M-1

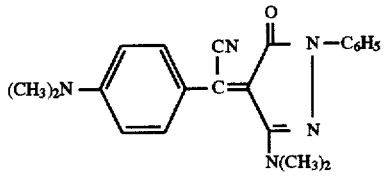

Magenta Dye M-2

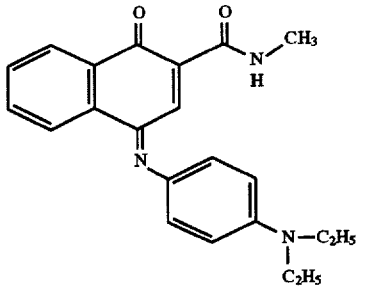

Cyan Dye C-1

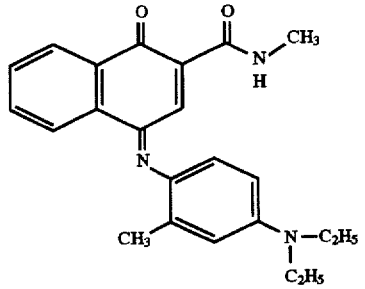

Cyan Dye C-2

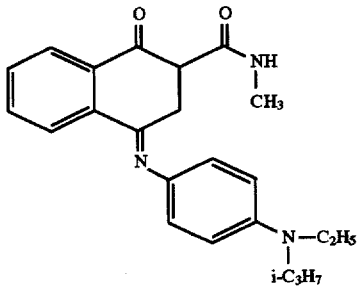

Cyan Dye C-3

A dye-donor element of sequential areas of yellow, magenta and cyan dyes was prepared by coating the following layers, in order, on one side of a 6 μm PET support:

1) a subbing layer of Tyzor® TBT titanium tetra-n-butoxide, (DuPont Corp.) (0.12 g/m$^2$) from a n-propyl acetate and 1-butanol solvent mixture;
2) a dye layer containing sequential, repeating areas of yellow, magenta and cyan dyes as follows:
   a) a yellow area comprising a mixture of yellow dye Y-1 (0.268 g/m$^2$), cellulose acetate propionate (0.359 g/m$^2$), poly (divinyl-benzene) 2 μm beads (0.006 g/m$^2$) and Fluorad® FC-430 (0.002 g/m$^2$) coated from a mixture of toluene, methanol and cyclopentanone;
   b) a magenta area comprising a mixture of magenta dye M-1 (0.169 g/m$^2$), magenta dye M-2 (0.184 g/m$^2$), cellulose acetate propionate (0.308 g/m$^2$), 2,3-dihydro-1,1,3-trimethyl-N-(2,4,6-trimethyl-phenyl-3-(4((2,4,6-trimethyl-phenyl)amino)carbonyl)-phenyl)-1H-indene-5-carboxamide (0.065 g/m$^2$), poly (divinylbenzene) 2 μm beads (0.006 g/m$^2$) and Fluorad® FC-430 (0.001 g/m$^2$) from a mixture of toluene, methanol and cyclopentanone;
   c) a cyan area comprising a mixture of cyan dye C-1 (0.129 g/m$^2$), cyan dye C-2 (0.117 g/m$^2$), cyan dye C-3 (0.279 g/m$^2$), cellulose acetate propionate (0.299 g/m$^2$), poly(divinyl-benzene) 2 μm beads (0.011 g/m$^2$) and Fluorad® FC-430 (0.0005 g/m$^2$) coated from a mixture of toluene, methanol and cyclopentanone.

On the other side of the dye-donor element were coated the same subbing layer as used on the dye side and a slipping layer of KS-1 (a poly(vinyl acetal) from Sekisui Chemical Co.) (0.379 g/m$^2$), PS-513 (an aminopropyl dimethyl-terminated polydimethylsiloxane from United Chemical Technologies, Inc. (0.011 g/m$^2$), p-toluenesulfonic acid (0.0003 g/m$^2$) and candelilla wax particles (Strahl and Pitsch) (0.022 g/m$^2$) coated from diethyl ketone.

Printing Conditions

The dye-receiver components as described above for Example 1 were attached to a conventional PVC support ID card at one end with a small piece of double-sided Scotch® tape. The dye side of the dye-donor element was placed in contact with the dye-receiving layer on the card as described above. The assemblage was placed between a motor driven platen (35 mm in diameter) and a Kyocera KBE-57-12MGL2 thermal print head which was pressed against the slip layer side of the dye donor element with a force of 31.2 Newtons.

The Kyocera print head has 672 independently addressable heaters with a resolution of 11.81 dots/mm of average resistance 1968 ohms. The imaging electronics were activated and the assemblage was drawn between the print head and the roller at 26.67 mm/s.

Coincidentally, the resistance elements in the thermal print head were pulsed on for 87.5 microseconds every 91 microseconds. Printing maximum density required 32 pulses "on" time per printed line of 3.175 milliseconds. The voltage supplied was 12.9 volts resulting in an energy of 4.0 J/cm$^2$ to print a maximum Status A density of about 2.0. The image was printed with a 1:1 aspect ratio.

After printing, the receiver components were removed from the supporting card and wrapped around a 7.9 mm mandrel five times in succession such that the image side was wound outside away from the mandrel. The receiver components were then subjected to an automated single arm scratch test using a 76.2 μm sapphire stylus on which the load could be varied. The following results were obtained:

TABLE 2

| Receiver Component | Subbing Layer | Point of Failure | Load at Failure |
|---|---|---|---|
| Invention 2 | Vinylidene chloride terpolymer | compliant layer/support interface | 170 |
| Control 2 | Poly (vinyl acetal) | Poly (vinyl acetal)/compliant layer interface | 30–60 |

For the control, failure in the scratch test occurred between the poly(vinyl acetal) compliant layer interface (confirmed by microscopy) with a load of 30–60 g on the stylus. No failure was observed at this interface unless the sample was rolled up on the mandrel. The invention sample did not fail at the vinylidene chloride terpolymer subbing-compliant layer interface in the scratch test. At a load of 170 g on the stylus, failure finally occurred at the interface between the compliant layer and the support. Thus, the invention subbing layer provided better adhesion than the control subbing layer after thermal printing and mechanical stressing.

EXAMPLE 3

Invention 3

A dye-receiver component having the vinylidene chloride terpolymer subbing layer was made as described in Example 1.

Control 3

A dye-receiver component having the poly(vinyl acetal) subbing layer was made as described in Example 1.

Control 4

A dye-receiver component was made similar to Control 3 except that the subbing layer was an aminofunctional organo-oxysilane, Prosil 221®, (PRC Inc.) (0.054 g/m$^2$) and an epoxy-terminated organo-oxysilane blended with a hydrophobic organo-oxysilane, Prosil 2210®, (PRC Inc.) (0.054 g/m$^2$) coated at 1% total solids from ethanol containing 15% by weight of water.

Control 5

A dye-receiver component was made similar to Control 3 except that the subbing layer was poly(vinyl formal), Formvar® (DuPont Corp.) (0.054 g/m$^2$) coated from a mixture of 60 wt. % toluene and 40 wt. % of 3A alcohol containing 5 wt. % water.

Control 6

A dye-receiver component was made similar to Control 3 except that the subbing layer was a terpolymer of vinyl chloride, vinyl acetate and maleic acid (Union Carbide Inc.) (0.054 g/m$^2$) coated from a 1:1 mixture of toluene and methyl ethyl ketone.

The dye-receiver components were attached to a conventional PVC support ID card at one end with a piece of double-sided Scotch® tape. The cards were then printed with a 7 channel neutral scale in an Edicon (a Kodak subsidiary) IR 300 SN Thermal ID Card Printer using the dye-donor element of Example 2.

After printing, the dye-receiver components were removed from the supporting card and wrapped on a mandrel five times as in Example 2. After the mandrel treatment, the adhesion of the subbing layer was assessed by placing the dye-receiver component on a hard flat surface and manually gouging lines about 25 mm long into the dye-receiver side by using a small, pointed spatula, attacking at a 45 degree angle with a moderate force. Failure of the subbing layer was revealed by occurrence of peeling in small sheets of the image-bearing layers. The following results were obtained:

| Receiver Component | Subbing Layer | Adhesion Test |
|---|---|---|
| Invention 3 | Vinylidene chloride terpolymer | No Peeling |
| Control 3 | Poly (vinyl acetal) | Peeling |
| Control 4 | Organo-oxysilanes | Peeling |
| Control 5 | Poly (vinyl formal) | Peeling |
| Control 6 | Vinyl chloride, vinyl acetate, maleic acid terpolymer | Peeling |

The above results show that the subbing layer of the invention provided good adhesion after printing and mechanical stressing as compared to four control subbing layers.

The invention has been described in detail with particular reference to preferred embodiments thereof, but it will be understood that variations and modifications can be effected within the spirit and scope of the invention.

What is claimed is:

1. A process of forming a dye transfer image comprising imagewise-heating a dye-donor element comprising a support having thereon a dye layer and transferring a dye image to a dye-receiving element to form said dye transfer image, said dye-receiving element comprising an identification card stock comprising a polymeric core substrate having on at least one side thereof the following layers in order: an oriented polymeric film, a cushion layer of an acrylic polymer, a subbing layer and an image-receiving layer; wherein said subbing layer comprises from about 5 to about 35% by weight of acrylonitrile, from about 2 to about 10% by weight of acrylic acid, and from about 55 to about 85% by weight of recurring units of vinylidene chloride.

2. The process of claim 1 wherein said oriented polymeric film is biaxially-oriented poly(ethylene terephthalate) and which is located on each side of said polymeric core.

3. The process of claim 2 wherein a dye image-receiving layer is applied to the outermost surface of both of said oriented polymeric films.

4. The process of claim 1 wherein said subbing layer comprises poly(acrylonitrile-co-vinylidene chloride-co-acrylic acid) (14:79:7 wt. ratio).

5. The process of claim 1 wherein said cushion layer is a copolymer of butylacrylate and acrylic acid.

6. The process of claim 1 wherein said polymeric core substrate comprises an amorphous polyester which contains titanium dioxide.

7. A thermal dye transfer assemblage comprising:

(a) a dye-donor element comprising a support having thereon a dye layer, and (b) a dye-receiving element comprising a support having thereon a dye image-receiving layer, said dye-receiving element being in a superposed relationship with said dye-donor element so that said dye layer is in contact with said dye image-receiving layer, wherein said dye-receiving element comprises an identification card stock comprising a polymeric core substrate having on at least one side thereof the following layers in order: an oriented polymeric film, a cushion layer of an acrylic polymer, a subbing layer and an image-receiving layer; wherein said subbing layer comprises from about 5 to about 35% by weight of acrylonitrile, from about 2 to about 10% by weight of acrylic acid, and from about 55 to about 85% by weight of recurring units of vinylidene chloride.

8. The assemblage of claim 7 wherein said oriented polymeric film is biaxially-oriented poly(ethylene terephthalate) and which is located on each side of said polymeric core.

9. The assemblage of claim 8 wherein a dye image-receiving layer is applied to the outermost surface of both of said oriented polymeric films.

10. The assemblage of claim 7 wherein said subbing layer comprises poly(acrylonitrile-co-vinylidene chloride-co-acrylic acid) (14:79:7 wt. ratio).

11. The assemblage of claim 7 wherein said cushion layer is a copolymer of butylacrylate and acrylic acid.

12. The assemblage of claim 7 wherein said polymeric core substrate comprises an amorphous polyester which contains titanium dioxide.

13. An identification card stock comprising a polymeric core substrate having on at least one side thereof the following layers in order: an oriented polymeric film, a cushion layer of an acrylic polymer, a subbing layer and an image-receiving layer; wherein said subbing layer comprises from about 5 to about 35% by weight of acrylonitrile, from about 2 to about 10% by weight of acrylic acid, and from about 55 to about 85% by weight of recurring units of vinylidene chloride.

14. The identification card stock of claim 13 wherein said oriented polymeric film is biaxially-oriented poly(ethylene terephthalate) and which is located on each side of said polymeric core.

15. The identification card stock of claim 14 wherein a dye image-receiving layer is applied to the outermost surface of both of said oriented polymeric films.

16. The identification card stock of claim 13 wherein said subbing layer comprises poly(acrylonitrile-co-vinylidene chloride-co-acrylic acid) (14:79:7 wt. ratio).

17. The identification card stock of claim 13 wherein said cushion layer is a copolymer of butylacrylate and acrylic acid.

18. The identification card stock of claim 13 wherein said polymeric core substrate comprises an amorphous polyester which contains titanium dioxide.

19. The identification card stock of claim 13 wherein said image-receiving layer contains a thermally-transferred dye image.

* * * * *